United States Patent [19]

Marquardt et al.

[11] 4,447,687

[45] May 8, 1984

[54] PUSHBUTTON SWITCH

[75] Inventors: Erich Marquardt, Rietheim-Weilh.; Ekkehard Sachs, Spaichingen, both of Fed. Rep. of Germany

[73] Assignee: Marquardt GmbH, Fed. Rep. of Germany

[21] Appl. No.: 416,546

[22] Filed: Sep. 10, 1982

[51] Int. Cl.[3] ..... H01H 13/66

[52] U.S. Cl. ..... 200/159 R; 200/5 A; 200/153 LA

[58] Field of Search ..... 200/5 A, 153 LA, 159 R

[56] References Cited

U.S. PATENT DOCUMENTS

| | | | |
|---|---|---|---|
| 2,894,080 | 7/1959 | Herrmann et al. | 200/153 LA |
| 3,219,776 | 11/1965 | Yerkovich | 200/153 LA |
| 4,186,290 | 1/1980 | Matsuo | 200/153 LA |
| 4,319,100 | 3/1982 | Tallody | 200/153 LA |

FOREIGN PATENT DOCUMENTS

| | | | |
|---|---|---|---|
| 1168686 | 12/1958 | France | 200/159 R |

*Primary Examiner*—John W. Shepperd

*Attorney, Agent, or Firm*—McGlew and Tuttle

[57] ABSTRACT

A pushbutton switch, suitable particularly for keyboards of business machines substantially comprises a cup-shaped casing which may be made in two parts and has its cup edge side closed by a pushbutton. Against the side of the button, the upper end of a return spring is applied whose lower end bears against an angle leg of a contact member, and which is secured against buckling preferably by a holding member. Another angle leg of the contact member applies against a shank surface which is provided with a shoulder for permitting an abrupt tilting of the contact member upon pushing the button. Movable contacts may be provided on one or the other angle legs of the contact member. The fixed contacts are then located accordingly. The fixed contacts may be formed by end portions of connecting elements extending to the outside or by elements of a circuit board. To assemble the keyboard a plurality of such switch casings are manufactured integrally with a cover plate. Beneath the individual buttons, a base plate is provided preferably carrying the fixed contacts.

23 Claims, 7 Drawing Figures

PUSHBUTTON SWITCH

FIELD AND BACKGROUND OF THE INVENTION

The present invention relates in general to switches and in particular to a new and useful pushbutton switch which includes a tilting contact member tiltably mounted in a casing and engageable by a biasing spring and pushbutton.

Pushbutton switches of this kind are known, and they are employed either individually or in groups. Groups of switches are used in business machines, for example. It depends very substantially on the specific use, whether pushbuttons with a long or short stroke or a smooth or relative tight action are required, while in all instances, low cost and ease of exchange are repair are of importance.

SUMMARY OF THE INVENTION

The present invention is directed to a further development of a switch of this kind, resulting in a simple construction, easy assemblage, and in an actuating force and operating stroke such as required particularly with business machines.

Accordingly an object of the present invention is to provide a pushbutton switch which comprises a casing, a pushbutton movable with respect to the casing, a contact member having at least two legs joined at a junction which is pivotally mounted in the casing at a electrically non-conducting bearing one of the legs extending transversely to the direction of displacement of the pushbutton and engaging a biasing spring positioned between that one leg and the pushbutton with the other leg extending substantially perpendicularly to the first mentioned leg and engaged against a lateral surface of a shank of the pushbutton.

Such a switch meets the requirements of a business machine and has a long life. This is obtained by a design according to which, contrary to a prior art construction of this kind, the switching member is mounted in an electrically non-conducting bearing. This is rather than providing the member to tilt on one of the fixed contacts. Usually, in such a switch, pressing of the pushbutton closes the circuit. Consequently, in the initial position of the contact member, no voltage is applied thereto.

The inventive pushbutton switch requires a minimum of rotary or tilting motion of its contact member and yet provides a relatively long stroke of the button. In addition, the switch may be designed for pushing the botton in farther by a certain distance, beyond the set closing position. This only increases the tension of the return spring and produces a stronger return force, in addition to the increased contact pressure. Therefore, if a business machine is concerned, the switch is suitable for persons with both a light and heavier stroke.

The shank surface on which the outer leg of the contact member slides during the switching operation, extends approximately, and preferably even excactly, in the direction of the button actuation.

The element for holding the spring and remote from the contact member is preferably formed by a cavity of the button. A relatively long spring with favorable characteristics can therefore be employed in spite of the relatively rugged construction.

According to a development of the invention, the retaining member for the spring end at the contact member side is formed by an extension stretching out substantially parallel to the other angle leg of the contact member and projecting into the spring. This extension not only serves as an additional element for guiding and holding the spring in both its end position, but also facilitates the assemblage of the switch. What axial length of the extension to choose depends on many factors, not least on the needed length of the spring which is designed as a helical compression spring. Two further developments of the invention provide, in this respect, that the extension is formed by a stud or by a bent free end portion of one of the angle legs of the contact member. In the first instance, the extension is relatively short, however, the last turn of the spring can be held and centered by its entire circumference, while in the second instance, the extension protrudes somewhat farther and the engagement of the extension is deeper and the spring can be supported on shoulders formed thereon, for tilting like a knife edge. In another embodiment, the bearing surface of the shank wall for the other angle leg of the contact member is recessed by a shoulder and this angle leg applies in the initial position of the button against the wall portion which is more remote from the spring. Upon pressing the button, this angle leg shifts along this remote wall portion up to the shoulder where it engages the recessed portion, thereby tilting the contact member by which the fixed contacts are then bridged. With a provided overtravel the recessed portion of the shank wall moves farther along the slide member in the direction of the pushing force.

Another object of the invention is to provide such a pushbutton switch wherein one of the legs of the contact member carries a movable contact while the other leg is designed at its free end by a slide portion having a hook-like cross section which engages the pushbutton shank.

This hook-like end makes possible an instantaneous switching-on operation and, on the other hand, forms a kind of run-on member insuring, in cooperation with the recess shoulder, an also instantaneous switching-off operation.

A further object of the invention is to provide such a pushbutton wherein the slide portion is provided to contact the pushbutton shank while a movable contact is disposed on either side of the slide portion.

This provides for a particularly rugged construction which is very reliable in service. In a development of this design, the fixed contacts may be embodied each by the end of a respective connecting element leading to the outside.

A still further object of the invention is to provide such a pushbutton switch wherein the contact member is provided with an opening forming a part of the bearing element and engaging over a strip-like portion of the casing which projects from the casing bottom and serves as the electrically non-conductive bearing.

The bottom of the casing is slightly elevated in this zone to enable the contact member to perform its tilting motion, namely to provide the needed clear space for the downward motion of the respective angle leg. Since the line of action of the spring extends laterally of the bearing, a force component perpendicular to the longitudinal axis of the spring is produced whereby the contact member is firmly urged into its bearing which, by itself, is open. An open bearing, on the other hand, has advantages in assemblage, since the contact member can simply be loosely inserted from above, with the terms "above" and "below", or "upper" and "lower" referring to the position as shown in the accompanying drawings.

Another object of the invention is to provide such a pushbutton switch wherein the casing is substantially sleeve shaped and the bearing for the contact member projects from an inwardly extending bottom of the casing at an end of the sleeve which is remote from the top key face of the pushbutton with fixed contacts of the casing provided on a base plate and protruding to the interior of the sleeve.

Here again, it is understood that the switching-on, the button is moved from above downwardly. The external or upper end of the sleeve is closed by a pushbutton of well known shape which is provided with an engageable shank. The fixed contacts may also be designed and made fast in a known manner, for example as rivets or whurl ends, or as printed elements, etc. The printed form is particularly suitable if a group of switches for a keyboard is provided. If the base plate is a so-called circuit board, the fixed contacts may take the form of contact pieces which are gold welded to the printed points or deposited by plating. Other prior art methods of constructing printed circuit boards for keyboards, particularly in the field of business machines, may also be used. What is substantial is to ensure that during an assemblage the contact members can always exactly be associated with the respective fixed contacts on the base plate. Should it be desired to make one or more of the switches ineffective or initially ineffective, it suffices to simply omit the contact member in the respective switch.

Another object of the invention is to provide such a pushbutton switch wherein the sleeve-like casing includes shoulder or outer collar for receiving a cover plate, with the sleeve extending through one of a variety of openings in the cover plate and with the cover plate and the base plate being held in an assembled state by connecting members, particularly screws, the base plate carrying the fixed contacts for all the switches. For example, tap holes for connecting screws may be provided in the cover plate. The assemblage thus becomes simpler than with the use of nuts, except that such nuts may be formed by injection molding.

To prevent warping of the relatively thin cover and/or base plate during a screwing together, another development of the invention provides that each connecting member is passed through a spacer sleeve inserted between the cover plate and the base plate.

Finally, another embodiment of the invention provides that a plurality of sleeve-shaped casings are connected to each other by webs provided on a common cover plate with the fixed contacts of all the switches provided on a common base plate which is connected to cover plate connecting members. In this instance, again, spacer sleeves may be interposed or formed on one of the plates if necessary. Instead of conventional screws, self-tapping screws may also be used.

A still further object of the invention is to provide a pushbutton switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Several embodiments of the invention are shown in the drawings in which.

DESCRIPTION OF THE PREFERRED EMBODIMENTS

Figures 1, 2:
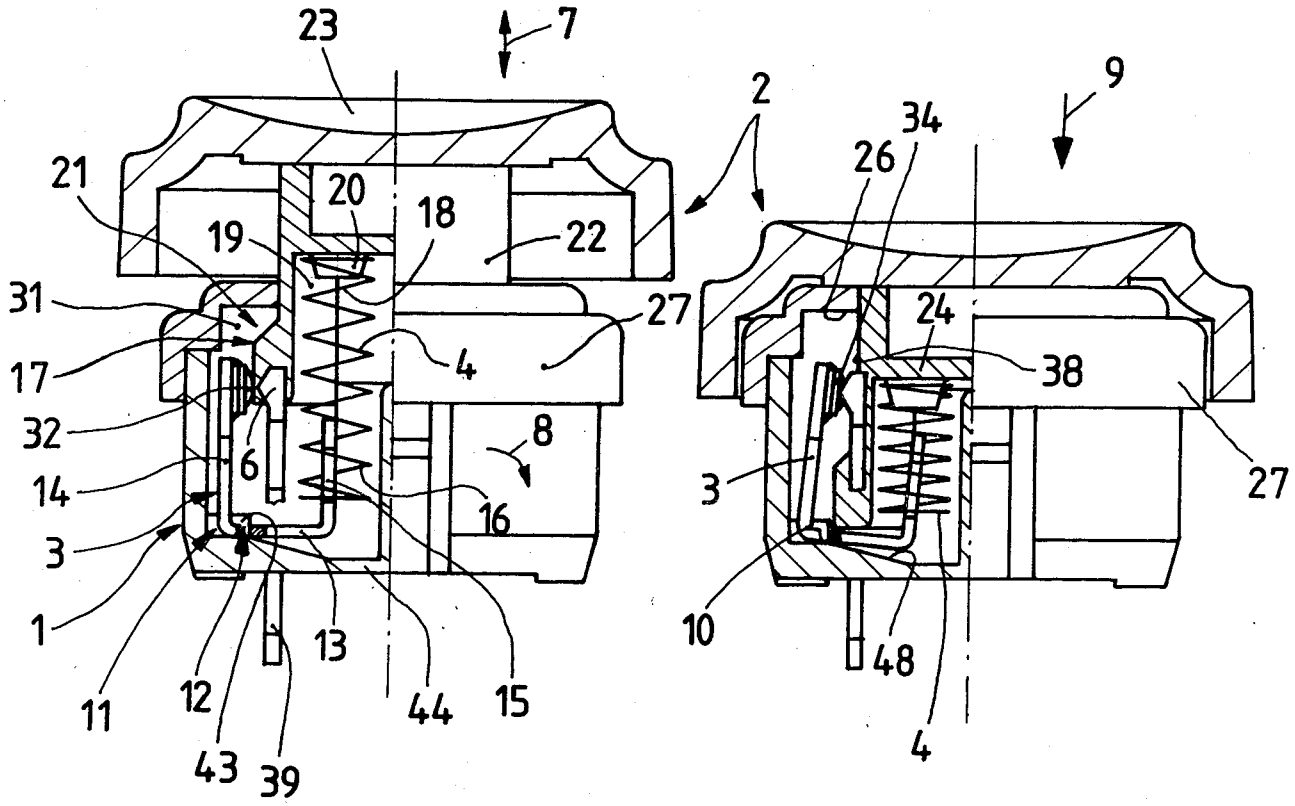
FIG. 1 is a partly sectional view of a first embodiment of the pushbutton switch, showing the button in its initial position.
FIG. 2 is a view corresponding to FIG. 1, showing the button in its switch-on position.
Figure 3:
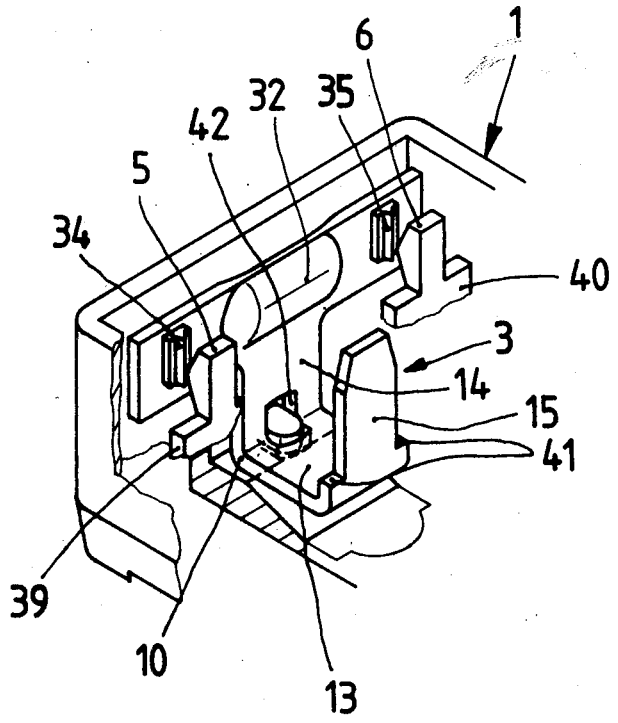
FIG. 3 is a perspective and cut-away view corresponding to FIG. 1, with the button omitted.

Referring to the drawings, and in particular to FIGS. 1 to 3, a pushbutton switch according to the invention comprises a casing 1, a pushbutton 2 mounted therein for displacement, a contact member 3 which is mounted for tilting within the casing 1, a return spring 4 provided between the contact member and pushbutton, and fixed contracts 5 and 6 provided on the casing. The direction of displacement of pushbutton 2 is indicated by double arrow 7, while arrow 8 is indicative of the motion of contact member 3 during a switching operation.

Pushbutton 2 is shown in FIG. 1 in its initial position and is pushed-in in the direction of arrow 9 (FIG. 2) while upon releasing the button, return spring 4 effects the motion back into the initial position against the direction of arrow 9.

Contact member 3 is substantially angle-shaped. The angle corner 10 forms a bearing element 11, or such an element is formed on the angle corner portion. In any case, this bearing element 11 cooperates with a bearing 12 which is fixed to the casing. The bearing is electrically non-conducting, so that no voltage is applied to contact member 3 in the initial position thereof. The embodiments of FIG. 4,6 and 7, have similar structures with similar or the same parts deisginated with the same reference numerals.

Figure 4:
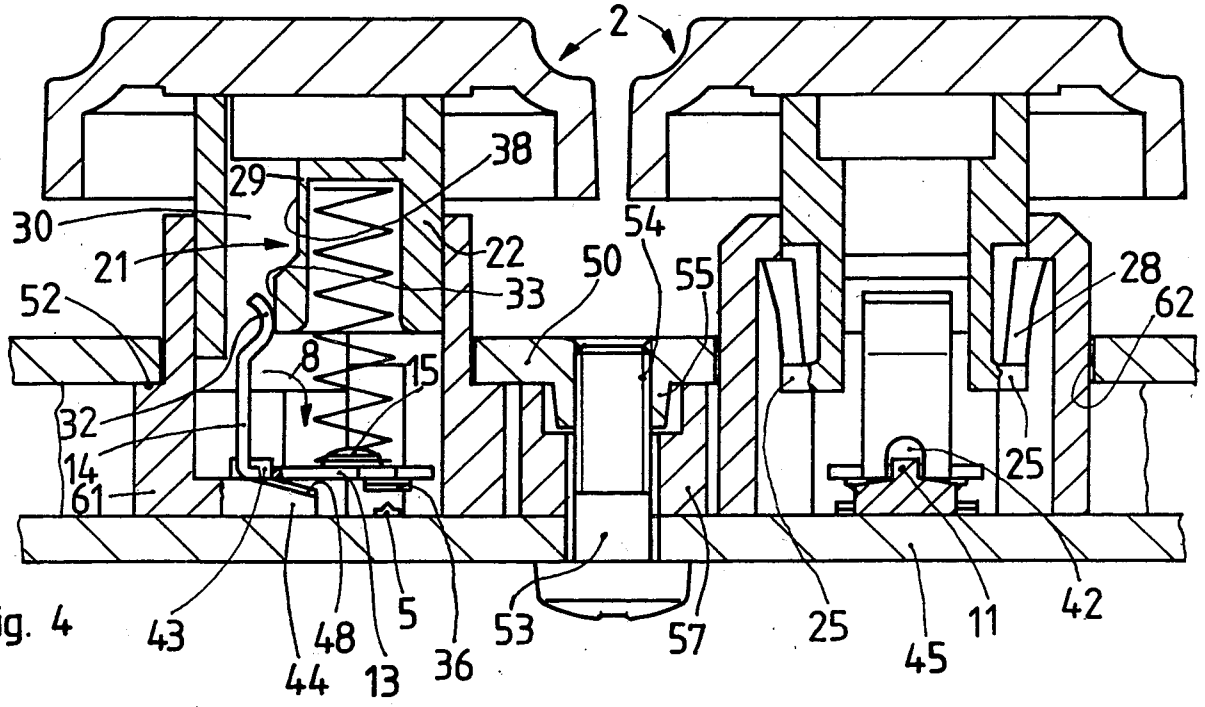
FIG. 4 is a sectional view of a second view of a second embodiment of the invention, as applied to a keyboard construction with a plurality of switches, with one of the two visible switches being in a position turned through 90° relative to the other.
Figure 6:
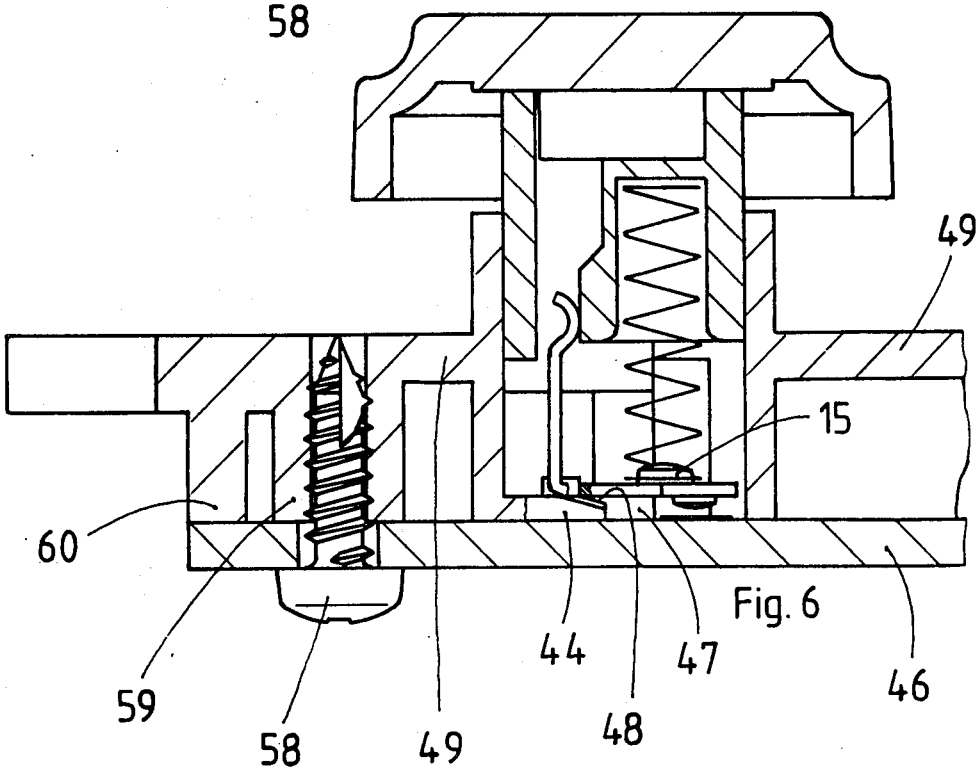
FIG. 6 is a view similar to FIG. 4, of a third embodiment of the invention.

As shown in FIGS. 1 to 3, return spring 4 bears against one angle leg 13 of contact member 3, which leg is provided, for this purpose, with a retaining member 15 extending substantially parallel to the other angle leg 14. Retaining member 15 projects into the interior of one end portion 16 of return spring 4 which is designed as a helical compression spring. The retaining member may be embodied by a bent free end portion of an angle leg 13, as shown in FIGS. 1 and 2, or by a rivetlike or stud element as shown in FIGS. 4 and 6.

At least in its initial position, the other angle leg 14, which is about perpendicular to leg 13 of contact member 3, applies laterally against a shank wall 17 of button 2. The other or upper spring end 18 is laterally retained by a holding element of button 2. The holding element is embodied either directly by the lateral walls of a cavity 19 provided in the form of a bore in the button shank, or by a stud 20 formed on the bottom of such a cavity and projecting into the interior of the spring end portion.

The surface of the shank 17 extends in the direction of actuation 7 of push button 2, so that up to reaching a shoulder 21 of the shank, the position of contact member 3 does not change. Pushbutton 2 is made of two parts, namely a tubular guide part 22 and an attached part 23 engageable thereon. Part 23 is of a well known design so that no explanation is necessary. Guide part 22 comprises a cross wall 24 forming at the same time the bottom of cavity 19 in which return spring 4 is accommodated. In all of the embodiments, the cross sectional area of holding element 19 forms only a part of the cross sectional area of guide part 22. Further, in all the embodiments at least one side wall protruding extension 25 (shown in FIG. 4) is provided on the free inner end of guide part 22, which extension, in the initial position of button 2, bears against the underside 26 of a casing cover 27 (FIG. 2), or a casing strip 28 (FIG. 4), and thus transmits the spring force to the casing.

In the embodiment of FIGS. 1 and 2, shank surface 17 for supporting the other angle leg 14 of contact member 3 is provided on the outside of guide part 22 of button 2, while in the other embodiments (such as FIG. 4) it is provided as an inside wall surface 29, extending in the same direction as the outer surfaces on guide part 22. Consequently, in the embodiments of FIGS. 4 to 7, angle leg 14 of contact member 3 projects into a cavity 30 of button 2, while in the embodiment of FIGS. 1 and 2, this angle leg 14 extends in the cavity 31 of the casing, outside guide part 22 of button 2. Shoulder 21 is common to both embodiments. The shoulder is not necessarily formed by a reduced wall thickness even though such a design is preferable for manufacturing reasons. Substantially, what matters is that slide member 32 of the other angle leg 14 of contact member 3 must apply against a slide surface 33 having a discontinuous shape, so that contact member 3 can abruptly change its position by tilting as indicated by arrow 8 as soon as shoulder 21 is reached. Surface 33 with shoulder 21 of button 2 from a cam surface on which member 32 can ride. This results in a sudden impingement of movable contacts 34, 35 (FIG. 3) or 36,37 (FIG. 5) against fixed contacts 5,6. Since contact member 3 is made of an electrically conducting material, the circuit is thereby closed. To ensure a reliably firm contact between movable contacts 34, 35, 36, 37 and fixed contacts 5,6, the depth of shoulder 21 is so dimensioned that slide piece 32 does not come into contact with recessed portion 38 of slide surface 33.

As shown in the drawings in the embodiment of FIGS. 1 to 3, movable contact 34, 35 are provided on angle leg 14, while in the other embodiments of the invention, these contacts are provided on angle leg 13 of contact member 3. The fixed contacts are mounted accordingly, of course. In the embodiment of FIGS. 1 and 2, the fixed contacts are secured to, or formed on, the free ends of each connecting element 39,40 leading from the outside into the casing, with the outer end forming a well known connecting lug for one end of the circuit line. Therefore, angle leg 13 of the embodiments of FIGS. 4 to 7 is substantially T-shaped as shown particularly in FIG. 5, with the movable contacts 36,37 being provided at the two ends of the cross bar of the T. Angle leg 14 of the embodiment of FIGS. 1–3, is T-shaped and the movable contacts are located similarly.

As shown in FIG. 3, a slide member 32 is provided between movable contacts 35 which is designed as a hook-like cross section formed by crimping, for example. In the embodiment of FIGS. 1–3, angle leg 13 is designed with a substantially constant width, and the same goes for angle leg 14 in the other embodiments of the invention. The hook-like free end is common to all the embodiments. The perspective view of FIG. 3 shows the shape of the bent free leg end of angle leg 13 very clearly which is shouldered and formed on the free end, so that supporting shoulders 41 for the spring end are formed.

Bearing element 11 of contact member 3 formed by a hole 42 which is particularly clearly shown in FIG. 3, is located at the lower end of angle leg 14. The hole extends up to angle corner 10. Hole 42 engages over a strip-like extension 43 of casing bottom 44 (FIG. 1), serving as a bearing 12. Casing bottom 34 is not necessarily continuous, it may be provided in an opening 47 or a hole, etc. as shown in FIGS. 4 to 7 through which fixed contacts 5,6 are accessible in instances where a group of switches or a keyboard is concerned and an additional common casting bottom is in the form of the mentioned circuit board is provided. To make allowance for the tilting of contact member 3 during a switching in the direction of arrow 8, casing bottom 44 slants from extension 43 toward fixed contacts 5, 6 which incline is shown at 48.

Figure 7:
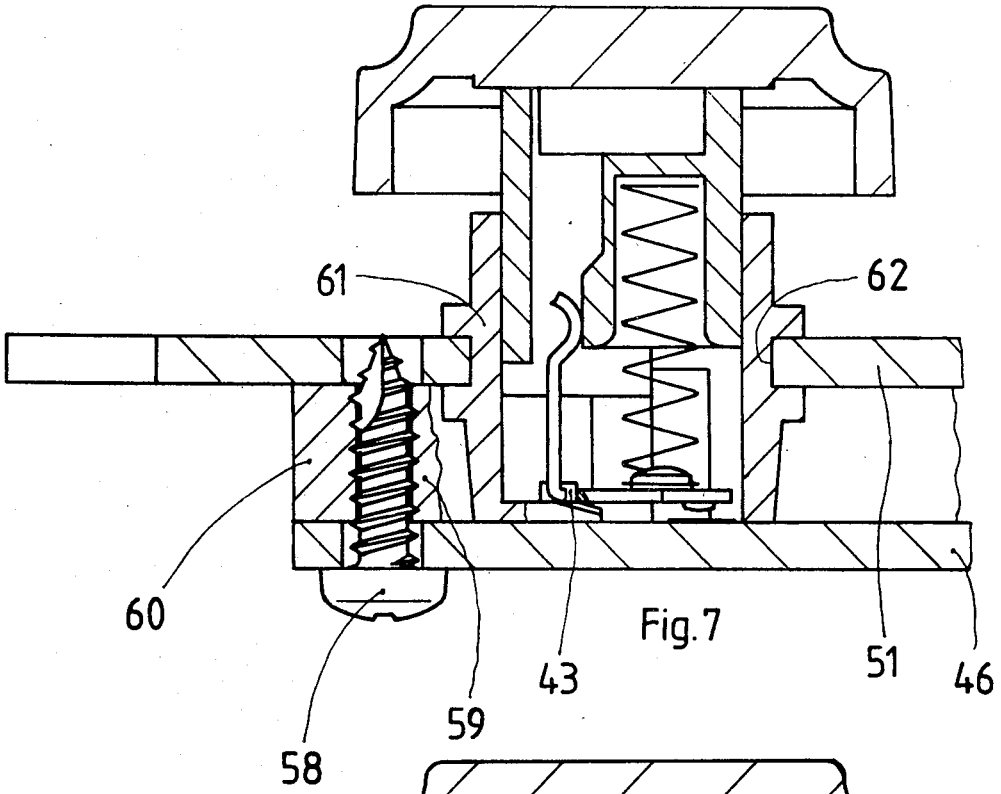
FIG. 7 is a view similar to FIG. 4 of a further embodiment of the invention.

Casing 1 of the switch has substantially the shape of a sleeve formed with a bottom 44 which is continuous or extends only over a part of the cross sectional area of the sleeve, as in the embodiments of FIGS. 4–7. In these latter embodiments, the opening 47 in the bottom is covered by base plate 45,46, as already explained. The upper end of the sleeve is closed by pushbutton 2. This sleeve may be a separately manufactured part (FIGS. 1,4,7) or a part in which is integrally formed with a cover plate 49 (FIG. 6). In the embodiments of FIGS. 4 and 7, separate counterplates 50,51 are employed.

Figure 5:
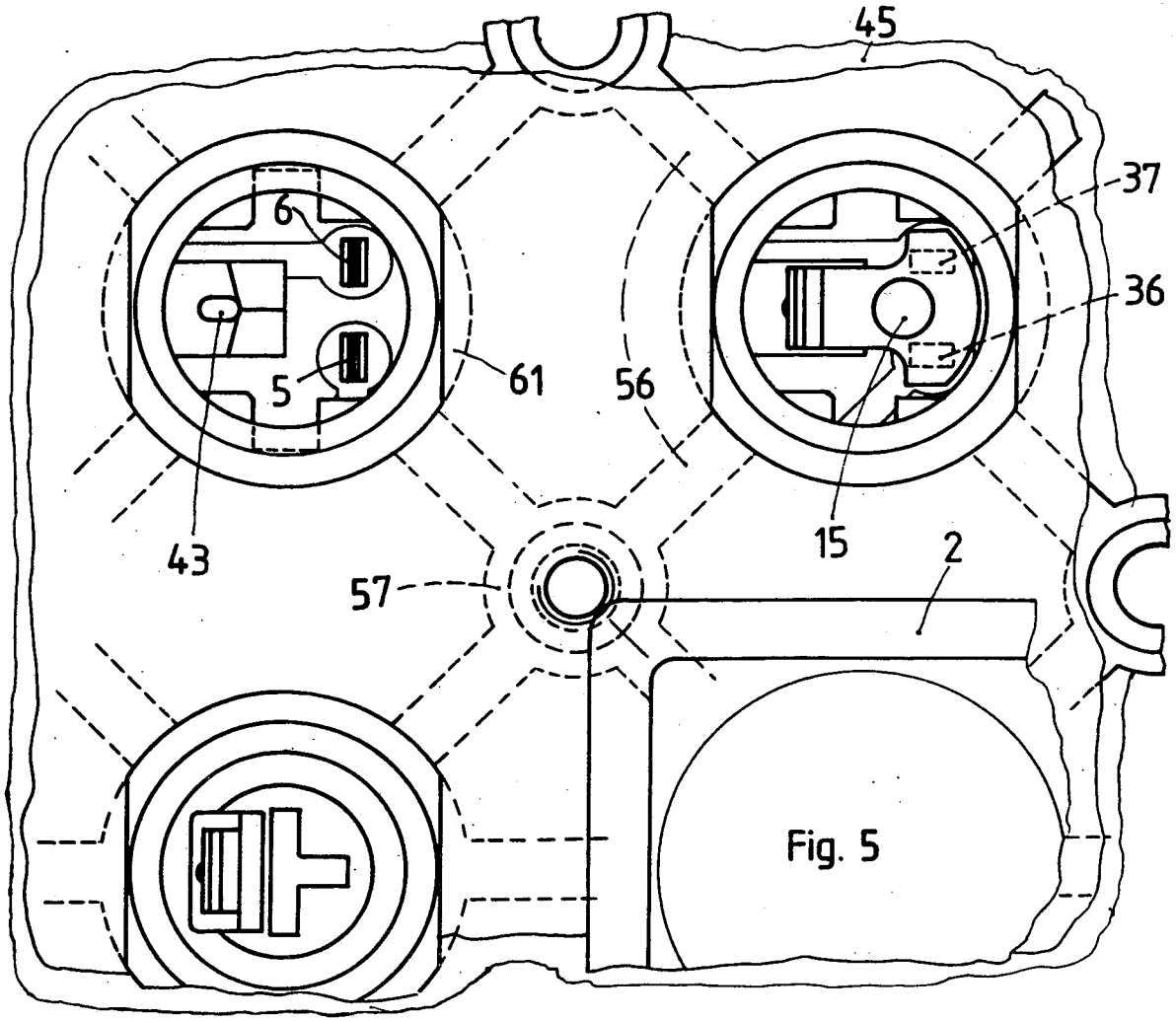
FIG. 5 is a top plan view corresponding to FIG. 4, with the button partly omitted.

The sleeve-like casing according to FIGS. 4 and 5 is provided with a shoulder 52 applying against the underside of cover plate 50. Consequently, the thicker portion of the sleeve is clamped between this cover plate 50 and the base plate or circuit board 45. These two plates are held assembled by means of screws 53 engaging a tap hole 54 of cover plate 50. At the respective location, a threaded sleeve 55 may be formed on cover plate 50 in addition. Also, spacer sleeve 57 and sleeve-casings 61 may be connected to each other by crosswise extending webs 56, to obtain a satisfactory bracing. To prevent the two plates from warping or bulging, each of screws 53 is concentrically surrounded by the spacer sleeve 57 applying against the inside surfaces of plates 50,45.

In the embodiment of FIG. 6, self-tapping screws 58 are employed which are screwed in the formed-on spacer sleeves 59. In addition or at least in the model zones, also other multiple switch or keyboard arrangements, spacer edge strips 60 may be provided.

The casing sleeve 61 of FIG. 7 is secured in corresponding opening 62 of cover plate 51 by clamping, or injection molding if the sleeve is of plastic and the cover plate 51 metallic. According to FIGS. 4 and 5, sleeve-shaped casings 61 and spacer sleeves 57 form a lattice work enclosed between base plate 45 and cover plate 50. A keyboard with a plurality of inventive switches may therefore be easily and quickly assembled of these sleeve parts. To accelerate the assemblage, a sufficiently wide cap is provided between the upper surface of sleeve-shaped casing 61 and openings 63 in cover plate 50, as shown in FIG. 4, through which the more slender neck portion of sleeve-casing 61 extends to the outside.

While specific embodiments of the invention have been shown and described in detail to illustrate the application of the principles of the invention, it will be understood that the invention may be embodied otherwise without departing from such principles.

What is claimed is:

1. A pushbutton switch comprising:

a casing having an electrically non-conducting fixed bearing therein;

a button movably mounted with respect to said casing in an actuating direction and from an open position to a closed position, said button having a cam surface;

a contact member having at least two legs joined at an angle junction, said angled junction pivotally mounted on said fixed bearing for permitting pivotal movement of said contact member;

biasing means engaged between one of said contact member legs and said button for biasing said button toward its open position, the other of said contact member legs bearing against said cam surface of said button;

at least one movable contact mounted on said contact member and at least one fixed contact mounted in said casing, said contact member movable by movement of said button to its closed position to establish engagement between said movable and fixed contacts.

2. A pushbutton switch according to claim 1, wherein said leg engaging said biasing means extends substantially transversely to said actuating direction of said button and the other of said legs extends substantially in said activating direction.

3. A pushbutton switch according to claim 2, including holding means in said button for holding said biasing means from moving laterally of said activating direction, said one leg engaged with said biasing means having a retaining member for holding said biasing means from movement laterally of said activating direction.

4. A pushbutton switch according to claim 3, wherein said biasing means comprises a spring having a top end engaged with said holding means and a bottom end engaged with said retaining member.

5. A pushbutton switch according to claim 4, wherein said holding means comprises said button defining a cavity therein for receiving said top end of said spring.

6. A pushbutton switch according to claim 5, wherein said holding means further comprises a stud connected to said button and extending in said cavity and engaging said top end of said spring.

7. A pushbutton switch according to claim 6, wherein said spring comprises a helical compression spring.

8. A pushbutton switch according to claim 7, wherein said retaining member comprises an extension of said contact member extending substantially parallel to said other leg engaged with said cam surface of said button, said retaining member extending into the interior of said spring from said bottom end thereof.

9. A pushbutton switch according to claim 7, wherein said retaining member comprises a stud connected to and extending from said one leg of said contact member, said stud engaged with said bottom end of said spring.

10. A pushbutton switch according to claim 4, including a pair of movable contacts connected to said contact member and a pair of fixed contacts connected to said casing each engageable by one of said movable contacts with said button in its closed position, one of said legs of said contact member carrying said movable contacts and the other leg of said contact member having a free end with a hook-shaped cross section forming a slide surface engaging said button cam surface.

11. A pushbutton switch according to claim 4, wherein said contact member includes a hole therein in the vicinity of said angled junction, said casing including a bottom and a projection extending from said bottom into said contact member opening forming said bearing.

12. A pushbutton switch according to claim 4, wherein said casing is sleeve-shaped, said fixed bearing in said casing projecting from a bottom of said casing at a lower end of said sleeve remote from a top end of said button, said fixed contact connected to a base plate forming said casing bottom.

13. A pushbutton switch according to claim 12, wherein said sleeve-shaped casing includes a shoulder, and a cover plate having openings therethrough for receiving at least a portion of said sleeve-shaped casing and engaging on said shoulder, and at least one connecting member interconnecting said base plate and said cover plate.

14. A pushbutton switch according to claim 13, including a spacer sleeve engaged around said connecting member and between said base plate and cover plate.

15. A pushbutton switch according to claim 12, including a plurality of said sleeve shaped casings each having a button movable with respect thereto and a contact member therein, each of said casings being sleeve shaped and be interconnected by at least one web, all of said casings having a common cover plate with openings therethrough for receiving at least a portion of each casing and a base plate connected to said cover plate.

16. A pushbutton switch according to claim 15 including a pair of fixed contacts in each casing connected to said base plate, and a pair of movable contacts connected to each of said contact members.

17. A pushbutton switch according to claim 4, wherein said casing includes a bottom portion having an incline inclined downwardly away from said fixed bearing for permitting pivotal movement of said contact member with said one leg engaging said spring moving toward said inclined surface with said button in its closed position.

18. A pushbutton switch according to claim 1, including a pair of movable contacts connected to said contact member and a pair of fixed contacts connected in said casing against which each of said two movable contacts is engaged with said button in its closed position.

19. A pushbutton switch according to claim 18, wherein one of said two legs is T-shaped, one of said movable contacts disposed on each end of said T-shaped leg.

20. A pushbutton switch according to claim 19, wherein said one of said legs extending substantially in said activating direction of said button is T-shaped and includes, between said movable contacts, a slide portion for slidably engaging said button cam surface.

21. A pushbutton switch according to claim 19, wherein the one of said legs engaging said spring is T-shaped.

22. A pushbutton switch according to claim 18, including a connecting element extending from an outside of said casing into said casing and connected to each of said fixed contacts respectively.

23. A pushbutton switch according to claim 1, wherein said cam surface includes a shank surface and a recessed shoulder area, said other leg of said contact member bearing against said shank surface with said button in its open position, said other leg moving off said shank surface and into said recess with said button moved into its closed position.

* * * * *